US007742066B2

(12) United States Patent
Choi

(10) Patent No.: US 7,742,066 B2
(45) Date of Patent: Jun. 22, 2010

(54) ORGANIC LIGHT EMITTING DIODE DISPLAY AND DRIVING METHOD THEREOF

(75) Inventor: Sang-Moo Choi, Gyeonggi-do (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1215 days.

(21) Appl. No.: 11/315,222

(22) Filed: Dec. 23, 2005

(65) Prior Publication Data

US 2006/0139266 A1 Jun. 29, 2006

(30) Foreign Application Priority Data

Dec. 24, 2004 (KR) ..... 10-2004-0112517

(51) Int. Cl.
*G09G 5/10* (2006.01)

(52) U.S. Cl. ..... 345/691; 345/77

(58) Field of Classification Search ..... 345/76, 345/77, 80, 82, 83, 204, 205, 690, 691, 693; 250/553

See application file for complete search history.

(56) References Cited

U.S. PATENT DOCUMENTS

| | | | | |
|---|---|---|---|---|
| 5,432,469 | A | 7/1995 | Tedrow | |
| 6,373,325 | B1 | 4/2002 | Kuriyama | |
| 6,831,621 | B2 * | 12/2004 | Nakano | 345/87 |
| 6,930,680 | B2 * | 8/2005 | Miyazawa | 345/205 |
| 7,154,454 | B2 * | 12/2006 | Okabe et al. | 345/76 |
| 7,268,751 | B2 * | 9/2007 | Yamazaki et al. | 345/76 |
| 7,342,559 | B2 * | 3/2008 | Shin | 345/76 |
| 2003/0076338 | A1 | 4/2003 | Hashimoto | |
| 2004/0095338 | A1 | 5/2004 | Miyazawa | |
| 2004/0113873 | A1 | 6/2004 | Shirasaki et al. | |
| 2004/0160406 | A1 | 8/2004 | Yamazaki et al. | |
| 2004/0165003 | A1 | 8/2004 | Shirasaki | |
| 2004/0179005 | A1 | 9/2004 | Jo | |
| 2004/0189627 | A1 | 9/2004 | Shirasaki et al. | |
| 2005/0030265 | A1 | 2/2005 | Miyagawa | |

(Continued)

FOREIGN PATENT DOCUMENTS

CN 1500226 5/2004

(Continued)

OTHER PUBLICATIONS

*Search Report* from the EPO issued in Applicant's corresponding European Patent Application No. 05112583.9-2205 dated Feb. 27, 2008.

(Continued)

*Primary Examiner*—Richard Hjerpe
*Assistant Examiner*—Tom V Sheng
(74) *Attorney, Agent, or Firm*—Robert E. Bushnell, Esq.

(57) ABSTRACT

An organic light emitting diode display and a driving method thereof, has an image displayed with uniform brightness. The method of driving a organic light emitting diode display, includes dividing one frame into one or more sub-frames, and supplying scan signals in sequence to some of plural scan lines provided in a pixel portion per sub-frame. The scan lines receiving the scan signals are differently set per sub-frame. With this configuration, an image is displayed with uniform brightness.

35 Claims, 12 Drawing Sheets

U.S. PATENT DOCUMENTS

2005/0078064 A1 4/2005 Min et al.

FOREIGN PATENT DOCUMENTS

| | | |
|---|---|---|
| JP | 10-333641 | 12/1998 |
| JP | 2001-060076 | 3/2001 |
| JP | 2002-108252 | 4/2002 |
| JP | 2003-066889 | 3/2003 |
| JP | 2003-177680 | 6/2003 |
| JP | 2004-219884 | 8/2004 |
| JP | 2004-294752 | 10/2004 |
| KR | 10-2002-0032570 | 5/2002 |
| US | 2002195968 | 12/2002 |
| US | 2004095298 | 5/2004 |
| WO | WO 98/33165 | 7/1998 |
| WO | 2003/091979 | 11/2003 |
| WO | WO 2004/001714 | 12/2003 |
| WO | 2004/100118 | 11/2004 |

OTHER PUBLICATIONS

European Office Action of the European Patent Application No. 05 11 2583, mailed on May 2, 2006.

Korean Office action corresponding to Korean Patent Application No. 10-2004-0112517, issued on Jul. 9, 2007.

*Office Action* from the SIPO issued in Applicant's corresponding Chinese Patent Application No. 200510121639.6 dated Jun. 27, 2008.

Japanese Office Action issued on Sep. 2, 2008 for corresponding Japanese Patent Application No. 2005-138540.

*Office action* from the State Intellectual Property Office P.R. China issued in Applicant's corresponding Chinese Patent Application No. 2005101152426 dated Sep. 28, 2007.

Request for Entry of the Accompanying Office Action for Japanese Office action attached herewith.

Office action from Japanese Patent Office issued in Applicant's corresponding Japanese Patent Application No. 2005-138540 dated Oct. 27, 2009.

* cited by examiner

ORGANIC LIGHT EMITTING DIODE DISPLAY AND DRIVING METHOD THEREOF

CLAIM OF PRIORITY

This application makes reference to, incorporates the same herein, and claims all benefits accruing under 35 U.S.C. §119 from an application for LIGHT EMITTING DISPLAY AND DRIVING METHOD THEREOF earlier filed in the Korean Intellectual Property Office on 24 Dec. 2004 and there duly assigned Serial No. 2004-112517.

BACKGROUND OF THE INVENTION

1. Field of the Invention

The present invention relates to an organic light emitting diode display and a driving method thereof, and more particularly, to an organic light emitting diode display and a driving method thereof, in which an image is displayed with uniform brightness.

2. Description of the Related Art

Various flat panel displays have recently been developed as alternatives to a relatively heavy and bulky cathode ray tube (CRT) display. The flat panel display includes a liquid crystal display (LCD), a field emission display (FED), a plasma display panel (PDP), an organic light emitting diode display (OLED), etc.

Among the flat panel displays, the organic light emitting diode display can emit light for itself by electron-hole recombination. Such an organic light emitting diode display has advantages in that response time is relatively fast and power consumption is relatively low. Generally, the organic light emitting diode display employs a transistor provided in each pixel for supplying current corresponding to a data signal to a light emitting device, thereby allowing the light emitting device to emit light.

FIG. 1 illustrates a conventional organic light emitting diode display.

Referring to FIG. 1, a conventional organic light emitting diode display includes a pixel portion 30 including a plurality of pixels 40 formed in a region defined by intersection of scan lines S1 through Sn and data lines D1 through Dm; a scan driver 10 to drive the scan lines S1 through Sn; a data driver 20 to drive the data lines D1 through Dm; and a timing controller 50 to control the scan driver 10 and the data driver 20.

The scan driver 10 generates scan signals in response to a scan control signal SCS from the timing controller 50, and supplies the scan signals to the scan lines S1 through Sn in sequence. Further, the scan driver 10 generates emission control signals in response to the scan control signal SCS, and supplies the emission control signals to emission control lines E1 through En in sequence.

The data driver 20 generates data signals in response to data control signal DCS from the timing controller 50, and supplies the data signals to the data lines D1 through Dm. At this time, the data driver 20 supplies the data signals corresponding to one horizontal line to the data lines D1 through Dm per one horizontal period.

The timing controller 50 generates the data control signal DCS and the scan control signal SCS corresponding to an external synchronization signal. The data control signal DCS and the scan control signal SCS are supplied from the timing controller 50 to the data driver 20 and the scan driver 10, respectively. Further, the timing controller 50 rearranges external data and supplies it to the data driver 20.

The pixel portion 30 receives first power ELVDD and second power ELVSS from an external power source, and supplies them to the respective pixels 40. When the first power ELVDD and the second power ELVSS are applied to the pixels 40, each pixel 40 displays an image corresponding to the received data signal. Here, emission time of each pixel 40 is controlled corresponding to the emission control signal.

Like the scan signals, the emission control signals are supplied to the $1^{st}$ through nth emission control lines En, in sequence. Here, every pixel 40 included in the pixel portion 30 does not emit light for a short time while the emission control signal is not supplied.

However, the first power ELVDD applied to the pixel portion 30 varies according to how many pixels 40 emit light, i.e., according to a pattern and brightness of an image displayed on the pixel portion 30. That is, the first power ELVDD supplied per frame is differently loaded to the pixels 40 according to how many pixels 40 emit light. For example, when relatively many pixels 40 emit light during one frame, the relatively high first power ELVDD is loaded to the pixels 40. On the other hand, when relatively small pixels 40 emit light during one frame, the relatively low first power ELVDD is loaded to the pixels 40. Therefore, voltage difference corresponding to the pattern of an image arises between the pixels 40 receiving the first power ELVDD 40, and thus there is a problem in that the image is displayed with non-uniform brightness. Further, due to voltage drop, the voltage of the first power ELVDD is differently applied to the pixels 40 according to the positions of the pixels 40 formed in the pixel portion 30, and thus the image is displayed with non-uniform brightness.

SUMMARY OF THE INVENTION

Accordingly, it is an aspect of the present invention to provide an organic light emitting diode display and a driving method thereof, in which an image is displayed with uniform brightness.

It is another aspect of the present invention to provide an organic light emitting diode display and a driving method thereof, in which one frame is divided into a plurality of sub-frames, and pixels receiving data signals during a sub-frame are maintained in a non-emission state, so that pixels are respectively charged with desired voltages, and thus an image is displayed with uniform brightness corresponding to the data signal.

It is yet another aspect of the present invention to provide an organic light emitting diode display and driving technique that is efficient, easy to implement, cost effective.

The foregoing and/or other aspects of the present invention are achieved by providing an organic light emitting diode display capable of dividing one frame into one or more sub-frames, the organic light emitting diode display includes: a plurality of scan lines; a plurality of data lines; a plurality of pixels connected to the scan lines and the data lines; a scan driver to supply scan signals in sequence to some of the scan lines per sub-frame; a data driver to supply data signals corresponding to the scan signals; and a plurality of first power sources connected to anode electrodes of light emitting devices provided in the pixels and provided as the same number as the sub-frames, with the scan lines receiving the scan signals are differently set per sub-frame.

According to an aspect of the invention, the scan driver supplies the scan signals to 1/i scan lines among the scan lines provided in the pixel portion per sub-frame (where, i is the number of sub-frames corresponding to one frame). Further, the data driver supplies the data signal to the pixels connected to the pixels receiving the scan signals during each sub-frame.

Another aspects of the present invention are achieved by providing a method of driving an organic light emitting diode display, including: dividing one frame into one or more sub-frames; and supplying scan signals in sequence to some of plural scan lines provided in a pixel portion per sub-frame, with the scan lines receiving the scan signals are differently set per sub-frame.

According to an aspect of the invention, the scan signals are supplied to 1/i scan lines among the scan lines provided in the pixel portion per sub-frame (where, i is the number of sub-frames corresponding to one frame). Further, data signals are supplied to the pixels receiving the scan signals during each sub-frame. Preferably, the method further includes controlling the pixels receiving the data signals do not emit light during the sub-frame for receiving the data signal.

Still another aspects of the present invention are achieved by providing a method of driving an organic light emitting diode display, including: dividing one frame into three or more sub-frames; and setting some pixels of a pixel portion as a non-emission state and the rest of pixels as an emission state per sub-frame.

According to an aspect of the invention, data signals are supplied to the pixels set as the non-emission state during each sub-frame. Here, 1/i pixels among the pixels provided in the pixel portion do not emit light per sub-frame (where, i is the number of sub-frames corresponding to one frame). Further, the pixels set as the non-emission state are different per sub-frame of one frame.

Yet other aspects of the present invention are achieved by providing a method of driving an organic light emitting diode display, including: dividing one frame into one or more sub-frames; setting the number of first power sources connected to an anode electrode of a light emitting device provided in a pixel to be equal to the number of sub-frames; and supplying data signals to some pixels provided in a pixel portion per sub-frame, with the pixels receiving the data signals do not emit light during each sub-frame.

According to an aspect of the invention, the data signals are supplied to 1/i pixels among the pixels provided in the pixel portion per sub-frame (where, i is the number of sub-frames corresponding to one frame). Here, the pixels provided in the pixel portion do not emit light during one or more sub-frames among i sub-frames, and emit light during the rest of sub-frames. Further, the pixel portion includes i first power sources, and the pixels that do not emit light during the same sub-frame are connected to the same first power source among i first power sources.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Hereinafter, preferable embodiments according to the present invention will be described with reference to the accompanying drawings, wherein the preferred embodiments of the present invention are provided to be readily understood by those skilled in the art.

Figure 1:
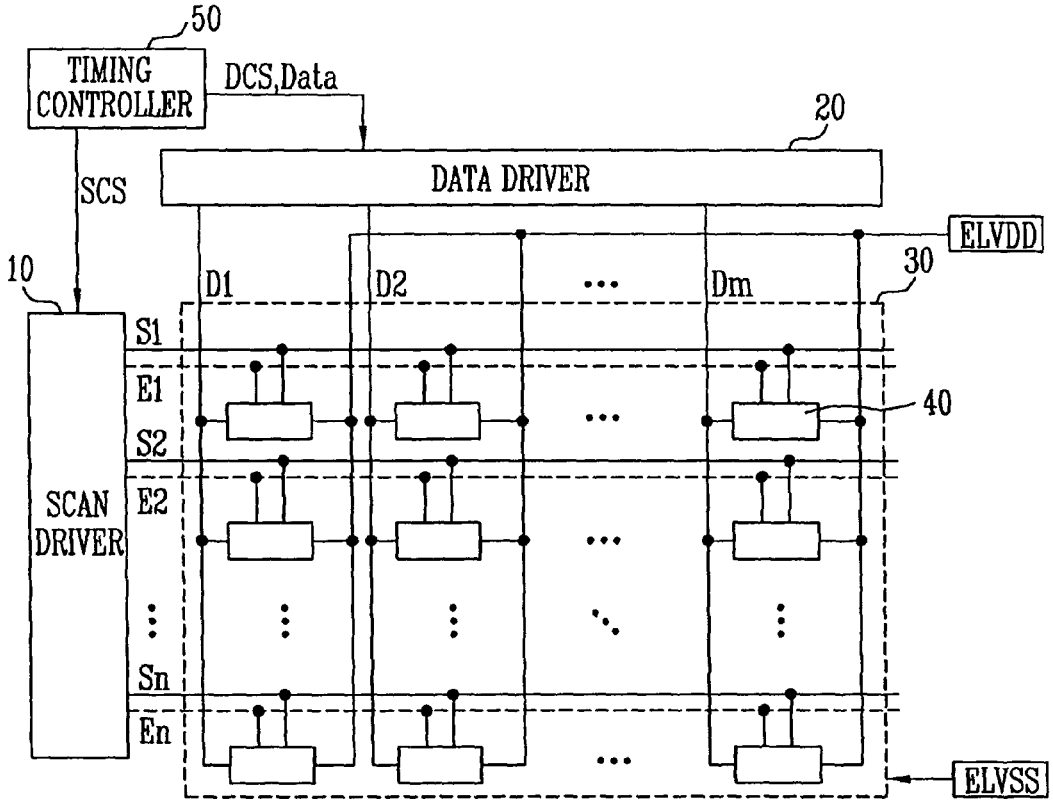
FIG. 1 (CONVENTIONAL ART)
FIG. 1 is a layout diagram of a conventional organic light emitting diode display.
Figure 2:
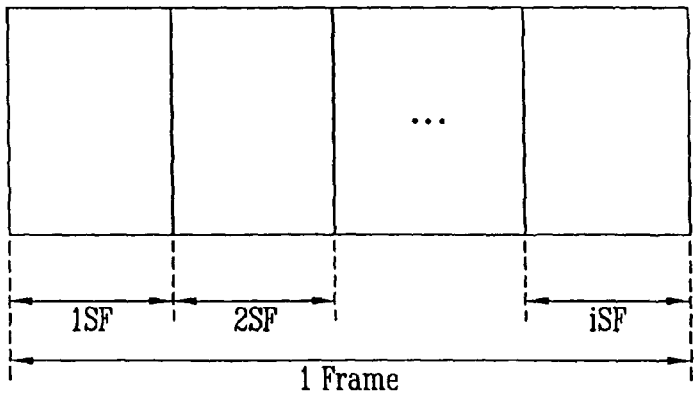
FIG. 2 illustrates a driving method for an organic light emitting diode display according to an embodiment of the present invention.

FIG. 2 illustrates a driving method for an organic light emitting diode display according to an embodiment of the present invention.

Referring to FIG. 2, an organic light emitting diode display according to an embodiment of the present invention is driven dividing one frame F into a plurality of sub-frames SF. For example, one frame F according to an embodiment of the present invention is divided into i sub-frames SF (where, i is a natural number). During each sub-frame SF, some pixels do not emit light, and the rest of the pixels emit light. Here, some pixels that do not emit light receive data signals during the sub-frame SF.

According to an embodiment of the present invention, the pixels that receive the data signal, i.e., the pixels that do not emit light are set differently from each other during each sub-frame SF of one frame. For example, the pixels, which receive the data signal during the $1^{st}$ sub-frame 1SF, do not receive the data signal during the $2^{nd}$ sub-frame 2SF through the $i^{th}$ sub-frame iSF. That is, the pixels according to an embodiment of the present invention do not emit light during one sub-frame among i sub-frames SF, and emit light during the rest of sub-frames. Alternatively, the pixels according to an embodiment of the present invention may not emit light during one or more sub-frames.

Hence, the number of pixels that do not emit light during each sub-frame is set as 1/i of the total number of pixels. For example, if one frame F is divided into four sub-frames and the total number of pixels provided in a pixel portion is 4,000, one thousand pixels do not emit light during each sub-frame. Meanwhile, if one frame is divided into two sub-frames, a time during which the pixels do not emit light becomes longer, so that a flicker is likely to arise. Therefore, it is preferable that one frame is divided into three or more sub-frames.

Figure 3:
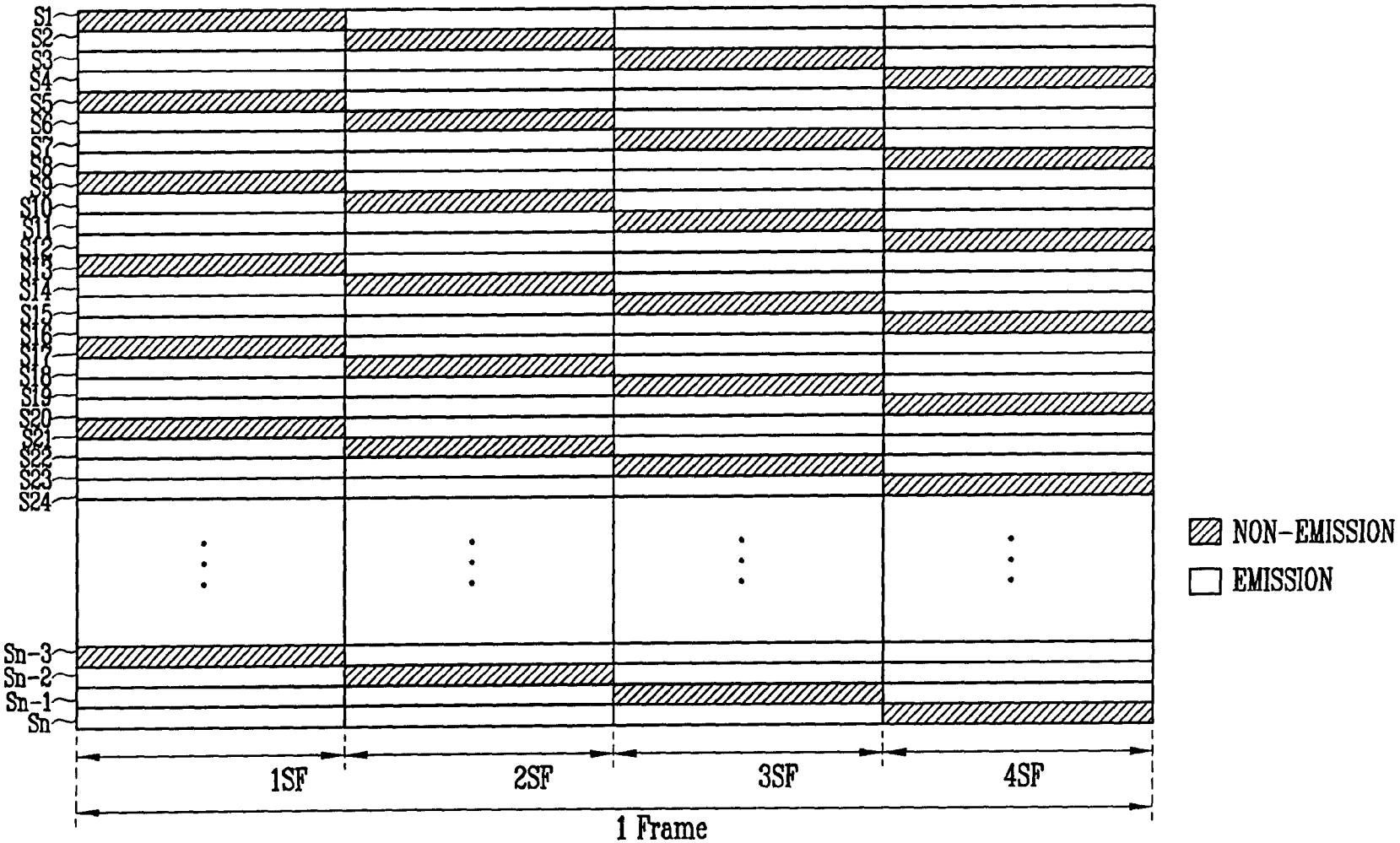
FIG. 3 shows pixels that do not emit light depending on the driving method illustrated in FIG. 2.

FIG. 3 shows pixels which do not emit light depending on the driving method illustrated in FIG. 2. For the sake of convenience and example, it will be herein below assumed that the pixel portion includes n scan lines S1 through Sn and one frame is divided into four sub-frames SF.

Referring to FIG. 3, one frame F is divided into four sub-frames, and thus pixels connected to different scan lines are set as a non-emission state per sub-frame. In other words, the pixels corresponding to non-emission are set differently per sub-frame.

During the $1^{st}$ sub-frame 1SF, the pixels connected to the $1^{st}$ scan line S1, the $5^{th}$ scan line S5 ($(i+1)^{th}$ scan line), the $9^{th}$ scan line S9 ($(2i+1)^{th}$ scan line), . . . , the $(n-3)^{th}$ scan line Sn−3 are set as the non-emission state. Further, the data signals are supplied during the $1^{st}$ sub-frame 1SF to the pixels connected to the $1^{st}$ scan line S1, the $5^{th}$ scan line S5, the $9^{th}$ scan line S9, . . . , the $(n-3)^{th}$ scan line Sn−3.

During the $2^{nd}$ sub-frame 2SF, the pixels connected to the $2^{nd}$ scan line S2, the $6^{th}$ scan line S6 ($(i+2)^{th}$ scan line), the $10^{th}$ scan line S10 ($(2i+2)^{th}$ scan line), . . . , the $(n-2)^{th}$ scan line Sn−2 are set as the non-emission state. Further, the data signals are supplied during the $2^{nd}$ sub-frame 2SF to the pixels connected to the $2^{nd}$ scan line S2, the $6^{th}$ scan line S6, the $10^{th}$ scan line S10, . . . , the $(n-2)^{th}$ scan line Sn−2.

During the $3^{rd}$ sub-frame 3SF, the pixels connected to the $3^{rd}$ scan line S3, the $7^{th}$ scan line S7 ($(i+3)^{th}$ scan line), the $11^{th}$ scan line S11 ($(2i+3)^{th}$ scan line), . . . , the $(n-1)^{th}$ scan line Sn−1 are set as the non-emission state. Further, the data signals are supplied during the $3^{rd}$ sub-frame 3SF to the pixels connected to the $3^{rd}$ scan line S3, the $7^{th}$ scan line S7, the $11^{th}$ scan line S11 ($(2i+3)^{th}$ scan line), . . . , the $(n-1)^{th}$ scan line Sn−1.

During the $4^{th}$ sub-frame 4SF, the pixels connected to the $4^{th}$ scan line S4, the $8^{th}$ scan line S8 ($2i^{th}$ scan line), the $12^{th}$ scan line S12 ($3i^{th}$ scan line), . . . , the $n^{th}$ scan line Sn are set as the non-emission state. Further, the data signals are supplied during the $3^{rd}$ sub-frame 3SF to the pixels connected to the $4^{th}$ scan line S4, the $8^{th}$ scan line S8, the $12^{th}$ scan line S12, . . . , the $n^{th}$ scan line Sn.

Thus, according to an embodiment of the present invention, one frame F is divided into a plurality of sub-frames SF, and the data signals are supplied to the pixels different per sub-frame. Here, the pixels receiving the data signal are set as the non-emission state during each sub-frame SF. As the pixels receiving the data signal are set as the non-emission state, the pixels display an image with uniform brightness, which will be described later.

Figure 4:
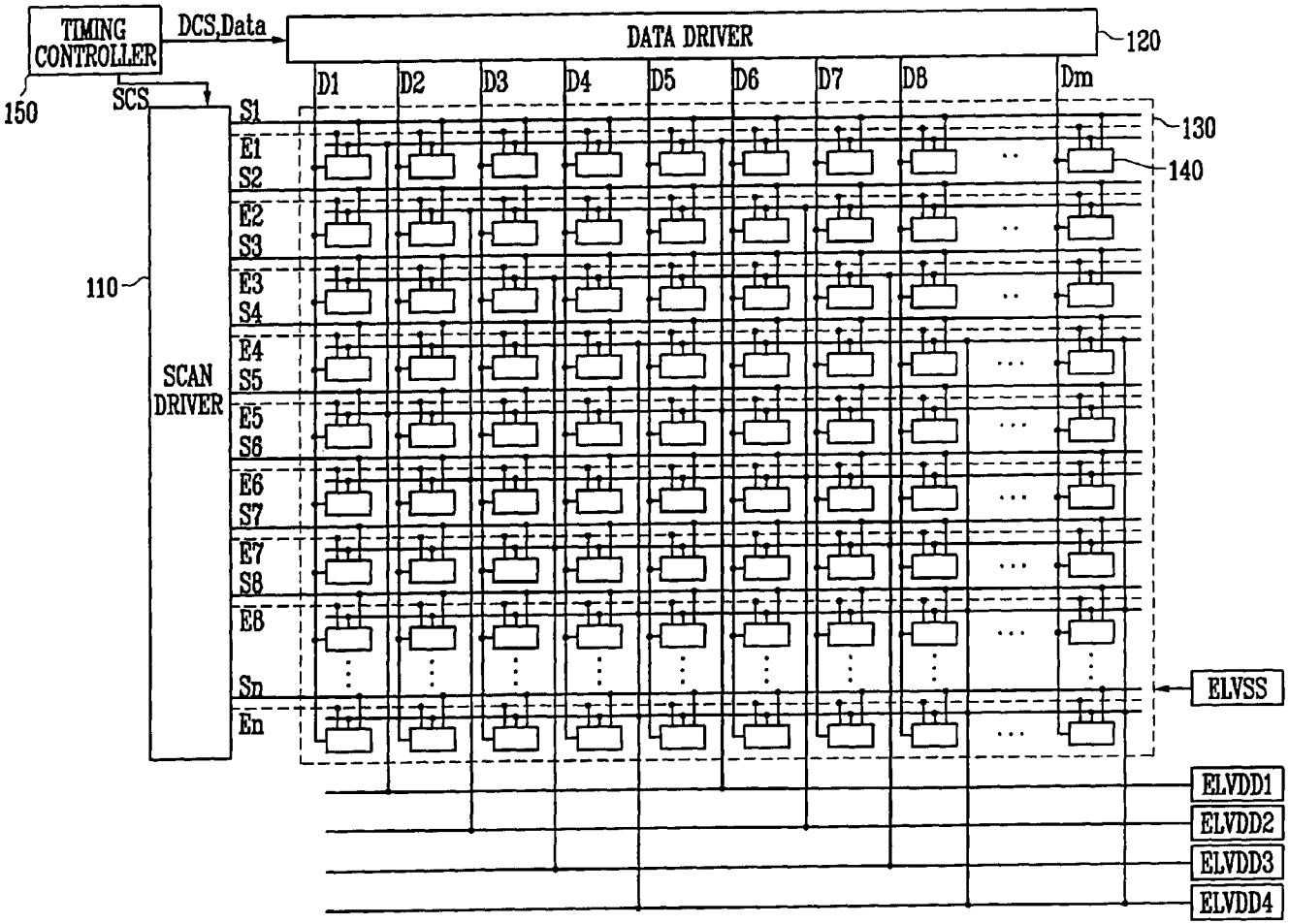
FIG. 4 is a layout diagram of an organic light emitting diode display according to a first embodiment of the present invention.

FIG. 4 is a layout diagram of an organic light emitting diode display according to a first embodiment of the present invention.

Referring to FIG. 4, an organic light emitting diode display according to a first embodiment of the present invention includes a pixel portion 130 including a plurality of pixels 140 formed in a region intersected by scan lines S1 through Sn and data lines D1 through Dm; a scan driver 110 to driver the scan lines S1 through Sn; a data driver 120 to drive the data lines D1 through Dm; and a timing controller 150 to control the scan driver 110 and the data driver 120.

The timing controller 150 generates a data control signal DCS and a scan control signal SCS in response to external synchronization signals, and supplies the data control signal DCS and the scan control signal SCS to the data driver 120 and the scan driver 110, respectively. Further, the timing controller 150 rearranges external data Data and supplies it to the data driver 120.

The scan driver 110 generates scan signals in response to the scan control signals SCS from the timing controller 150, and supplies them to the scan lines S. Here, the scan driver 110 sequentially supplies the scan signals to the scan lines S connected to the pixels 140 that receives the data during each sub-frame, i.e., which are set as the non-emission state. For example, in a case where the pixel portion 130 is formed with n scan lines S1 through Sn, the scan driver 110 supplies the scan signals to n/i scan lines S during each sub-frame.

Figure 5:
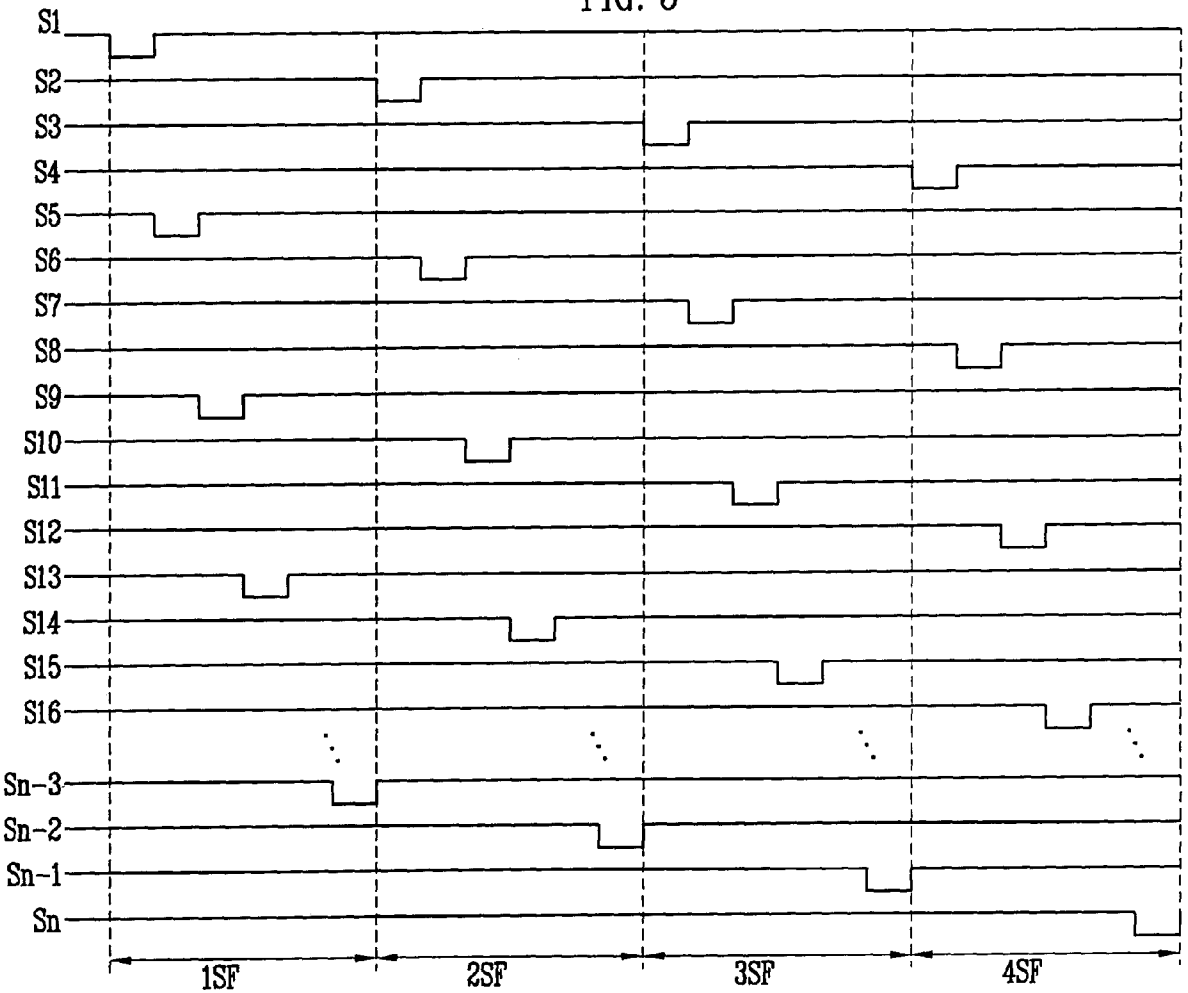
FIG. 5 shows waveforms of scan signals supplied from a scan driver of FIG. 4.

That is, the scan driver 110 supplies the scan signals to some scan lines S in sequence during each sub-frame. Here, the scan lines S receiving the scan signals are differently set per each sub-frame. For example, when the pixels are set as the non-emission state during the sub-frame as shown in FIG. 3, the scan driver 110 supplies the scan signals as shown in FIG. 5.

In more detail, the scan driver 110 supplies the scan signals to the $1^{st}$ scan line S1, the $5^{th}$ scan line S5, the $9^{th}$ scan line S9, . . . , the $(n-3)^{th}$ scan line Sn−3 in sequence during the $1^{st}$ sub-frame 1SF. Further, the scan driver 110 supplies the scan signals to the $2^{nd}$ scan line S2, the $6^{th}$ scan line S6, the $10^{th}$ scan line S10, . . . , the $(n-2)^{th}$ scan line Sn−2 in sequence during the $2^{nd}$ sub-frame 2SF. Also, the scan driver 110 supplies the scan signals to the $3^{rd}$ scan line S3, the $7^{th}$ scan line S7, the $11^{th}$ scan line S11, . . . , the $(n-1)^{th}$ scan line Sn−1 in sequence during the $3^{rd}$ sub-frame 3SF. Further, the scan driver 110 supplies the scan signals to the $4^{th}$ scan line S4, the $8^{th}$ scan line S8, the $12^{th}$ scan line S12, . . . , the $(n)^{th}$ scan line Sn in sequence during the $4^{th}$ sub-frame 4SF.

The data driver 120 generates data signals in response to the data control signals DCS from the timing controller 150, and supplies them to the data lines D1 through Dm in sequence. Here, the data driver 120 supplies the data signals corresponding to the scan signals supplied from the scan driver 110. That is, the data driver 120 supplies the data signals to the pixels 130 which do not emit light during each sub-frame.

For example, the data driver 120 supplies the data signals to the pixels 140 connected to the $1^{st}$ scan line S1, the $5^{th}$ scan line S5, the $9^{th}$ scan line S9, . . . , the $(n-3)^{th}$ scan line Sn−3 in correspondence to the scan signals supplied in sequence during the $1^{st}$ sub-frame 1SF. Further, the data driver 120 supplies the data signals to the pixels 140 connected to the $2^{nd}$ scan line S2, the $6^{th}$ scan line S6, the $10^{th}$ scan line S10, . . . , the $(n-2)^{th}$ scan line Sn−2 in correspondence to the scan signals supplied in sequence during the $2^{nd}$ sub-frame 2SF. Also, the data driver 120 supplies the data signals to the pixels 140 connected to the $3^{rd}$ scan line S3, the $7^{th}$ scan line S7, the $11^{th}$ scan line S11, . . . , the $(n-1)^{th}$ scan line Sn−1 in correspondence to the scan signals supplied in sequence during the $3^{rd}$ sub-frame 3SF. Further, the data driver 120 supplies the data signals to the pixels 140 connected to the $4^{th}$ scan line S4, the $8^{th}$ scan line S8, the $12^{th}$ scan line S12, . . . , the (n) scan line Sn in correspondence to the scan signals supplied in sequence during the $4^{th}$ sub-frame 4SF.

The pixel portion 130 receives external first power ELVDD and external second power ELVSS through a first power line ELVDD and a second power line ELVSS, respectively. Here, the first power line ELVDD is divided into a plurality of power lines corresponding to the number of sub-frames. For example, in a case where one frame is divided into four sub-frames, the first power line ELVDD is divided into a first divided power line ELVDD1, a second divided power line ELVDD2, a third divided power line ELVDD3, and a fourth divided power line ELVDD4. At this time, the first, second, third and fourth divided power ELVDD1, ELVDD2, ELVDD3 and ELVDD4 are set to have the same voltage level as the first power ELVDD.

The first divided power line ELVDD1 is connected to the pixels that receive the data signals during the $1^{st}$ sub-frame. The second divided power line ELVDD2 is connected to the pixels that receive the data signals during the $2^{nd}$ sub-frame. The third divided power line ELVDD3 is connected to the pixels that receive the data signals during the $3^{rd}$ sub-frame. The fourth divided power line ELVDD1 is connected to the pixels that receive the data signals during the $4^{th}$ sub-frame.

The pixels 140, connected between one of the first through fourth divided power lines ELVDD1 through ELVDD4 and a second power line ELVSS, receive the data signals during one of the plurality of sub-frames, and display an image corresponding to the data signal during the rest of the sub-frames.

Figure 6:
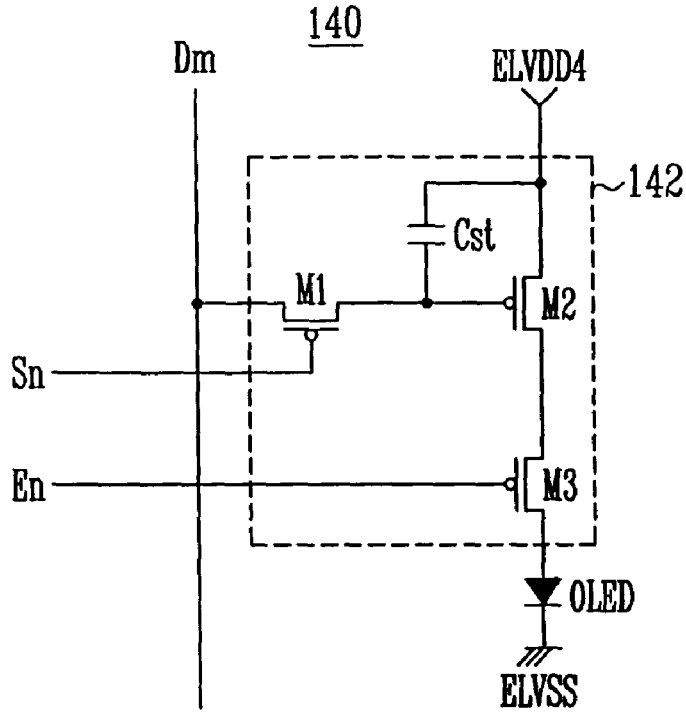
FIG. 6 is a circuit diagram of a pixel according to an embodiment of the present invention.

FIG. 6 is a circuit diagram of a pixel according to an embodiment of the present invention. For the sake of convenience, the pixel connected to the $m^{th}$ data line Dm and the $n^{th}$ scan line Sn will be exemplarily described. Hence, the pixel shown in FIG. 6 is connected with the fourth divided power ELVDD4.

Referring to FIG. 6, each pixel 140 according to an embodiment of the present invention includes a pixel circuit 142 connected with the light emitting device OLED, the data line Dm, the scan line Sn, and the emission control line En, and controlling the light emitting device OLED.

The light emitting device OLED includes an anode electrode connected to the pixel circuit 142 and a cathode electrode connected to the second power line ELVSS. Here, the light emitting device OLED emits light corresponding to current supplied from the pixel circuit 142.

The pixel circuit 142 includes a first transistor M1, a second transistor M2, a third transistor M3 and a capacitor Cst. The first transistor M1 is turned on when the scan signal is supplied to the $n^{th}$ scan line Sn. When the first transistor M1 is turned on, the data signal is supplied from the data line Dm to the capacitor Cst. At this time, the capacitor Cst is charged with voltage corresponding to the data signal when the first transistor M1 is turned on.

The second transistor M2 supplies current corresponding to the voltage charged in the capacitor Cst to the third transistor M3. Here, the third transistor M3 is connected between the second transistor M2 and the light emitting device OLED. Further, the third transistor M3 is turned off for a period of time while the emission control signal is supplied, and turned on the rest of periods.

As shown in FIG. 6, the pixel 140 is maintained as the non-emission state during the $4^{th}$ sub-frame 4SF while receiving the data signal. Substantially, all pixels 140 connected to the fourth divided power line ELVDD4 do not emit light during the $4^{th}$ sub-frame 4SF. Then, the current does not flow in the fourth divided power line ELVDD4 during the $4^{th}$ sub-frame 4SF, so that there is no voltage drop in the fourth divided power line ELVDD4. As there is no voltage drop in the fourth divided power line ELVDD4 during the $4^{th}$ sub-frame 4SF, the capacitors C of the pixels 140 receiving the data signals during the $4^{th}$ sub-frame 4SF are charged with the voltage correctly corresponding to the data signal without loss.

Meanwhile, while the pixels 140 receiving the data signal during the $4^{th}$ sub-frame 4SF emit light, a predetermined current flows in the fourth divided power line ELVDD4 and thus the voltage drop arises in the fourth divided power line ELVDD4. As the voltage drop arises in the fourth divided power line ELVDD4, voltage applied to a gate electrode of the second transistor M2 connected to the fourth divided power line ELVDD4 via the capacitor Cst varies corresponding to the voltage drop in the fourth divided power line ELVDD4. In other words, the coupling effect of the capacitor Cst causes the voltage applied to the gate electrode of the second transistor M2 to vary corresponding to the voltage drop in the fourth divided power line ELVDD4. Then, voltage difference between the gate electrode and a source electrode of the second transistor M2 is uniformly maintained regardless of the voltage drop in the fourth divided power ELVDD4. Thus, according to an embodiment of the present invention, an image is displayed with uniform brightness depending on the voltage charged in the capacitor Cst.

According to an embodiment of the present invention, one frame is divided into one or more sub-frames, and the pixels receiving the data signal during the sub-frame are maintained in the non-emission state, thereby displaying an image with uniform brightness. Here, various methods can be used to maintain the pixels in the non-emission state.

For example, the voltage levels of the first divided power ELVDD1, the second divided power ELVDD2, the third divided power ELVDD3 and the fourth divided power ELVDD4 are used to set the pixel 140 as the non-emission state.

During the $1^{st}$ sub-frame 1SF, the voltage level of the first divided power ELVDD1 can be lowered to make the light emitting device OLED to not emit light. For example, the first divided power ELVDD1 can be set to have the same voltage level as the second power ELVSS during the $1^{st}$ sub-frame 1SF. Thus, the first divided power ELVDD1 is lowered during the $1^{st}$ sub-frame 1SF, so that the pixels 140 connected to the first divided power line ELVDD1 do not emit light.

During the $2^{nd}$ sub-frame 2SF, the voltage level of the second divided power ELVDD2 can be lowered to make the light emitting device OLED to not emit light. For example, the second divided power ELVDD2 can be set to have the same voltage level as the second power ELVSS during the $2^{nd}$ sub-frame 2SF. In the meantime, the voltage level of the first divided power ELVDD1 is increased during the $2^{nd}$ sub-frame 2SF, so that the light emitting device OLED emits light.

Likewise, the voltage level of third divided power ELVDD3 is lowered during the $3^{rd}$ sub-frame, and the voltage level of the fourth divided power ELVDD4 is lowered during the $4^{th}$ sub-frame, thereby maintaining some pixels in the non-emission state during a predetermined sub-frame.

Figure 7:
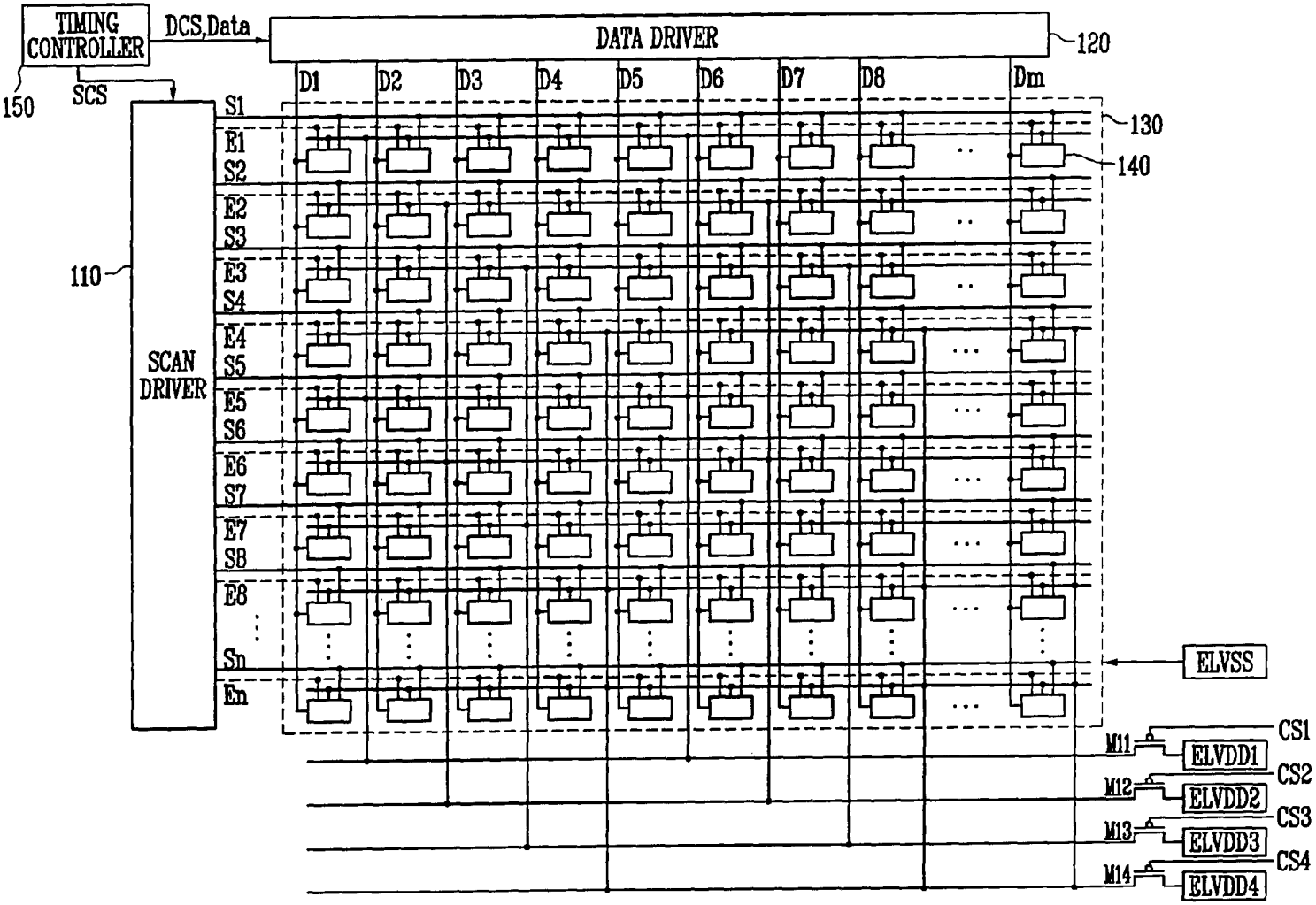
FIG. 7 is a layout diagram of an organic light emitting diode display according to a second embodiment of the present invention.

FIG. 7 is a layout diagram of an organic light emitting diode display according to a second embodiment of the present invention.

Referring to FIG. 7, the organic light emitting diode display according to the second embodiment of the present invention additionally includes first through fourth transistors M1 through M14 respectively connected to the first through fourth divided power lines ELVDD1 through ELVDD4 in order to maintain some pixels in the non-emission state during a predetermined sub-frame.

Figure 8:
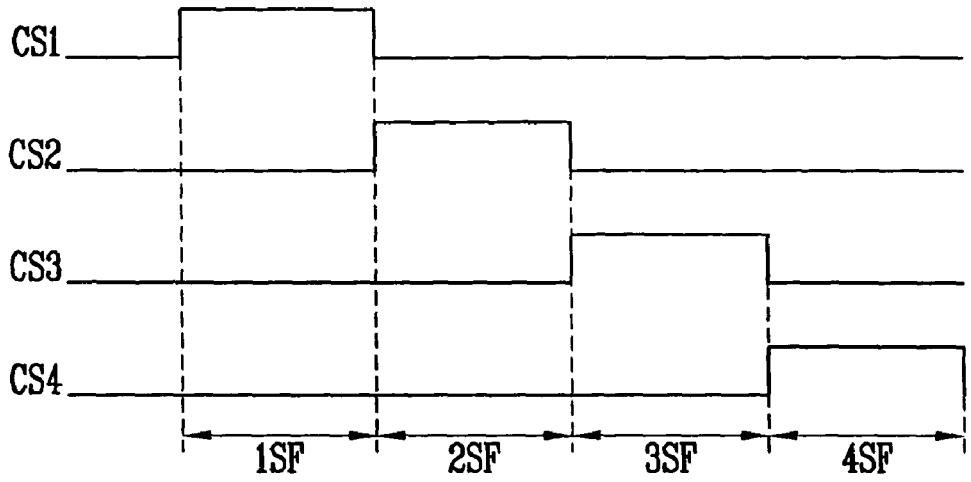
FIG. 8 shows waveforms of control signal supplied to transistors of FIG. 7.

The first transistor M11 is connected to the first divided power line ELVDD1. Here, the first transistor M11 is turned off during the $1^{st}$ sub-frame in response to an external first control signal CS1 (refer to FIG. 8), and turned on during the rest of frames 2SF through 4SF. Thus, the pixels connected to the first divided power line ELVDD 1 do not emit light during the $1^{st}$ sub-frame 1SF.

The second transistor M12 is connected to the second divided power line ELVDD2. Here, the second transistor M12 is turned off during the $2^{nd}$ sub-frame in response to an external second control signal CS2 (refer to FIG. 8), and turned on during the rest of frames 1SF, 3SF and 4SF. Thus, the pixels connected to the second divided power line ELVDD2 do not emit light during the $2^{nd}$ sub-frame 2SF.

The third transistor M13 is connected to the third divided power line ELVDD3. Here, the third transistor M13 is turned off during the 3rd sub-frame in response to an external third control signal CS3 (refer to FIG. 8), and turned on during the rest of the frames 1SF, 2SF and 4SF. Thus, the pixels connected to the third divided power line ELVDD3 do not emit light during the 3rd sub-frame 3SF.

The fourth transistor M14 is connected to the fourth divided power line ELVDD4. Here, the fourth transistor M14 is turned off during the 4th sub-frame in response to an external fourth control signal CS4 (refer to FIG. 8), and turned on during the rest of the frames 1SF through 3SF. Thus, the pixels connected to the fourth divided power line ELVDD4 do not emit light during the 4th sub-frame 4SF.

Figure 9:
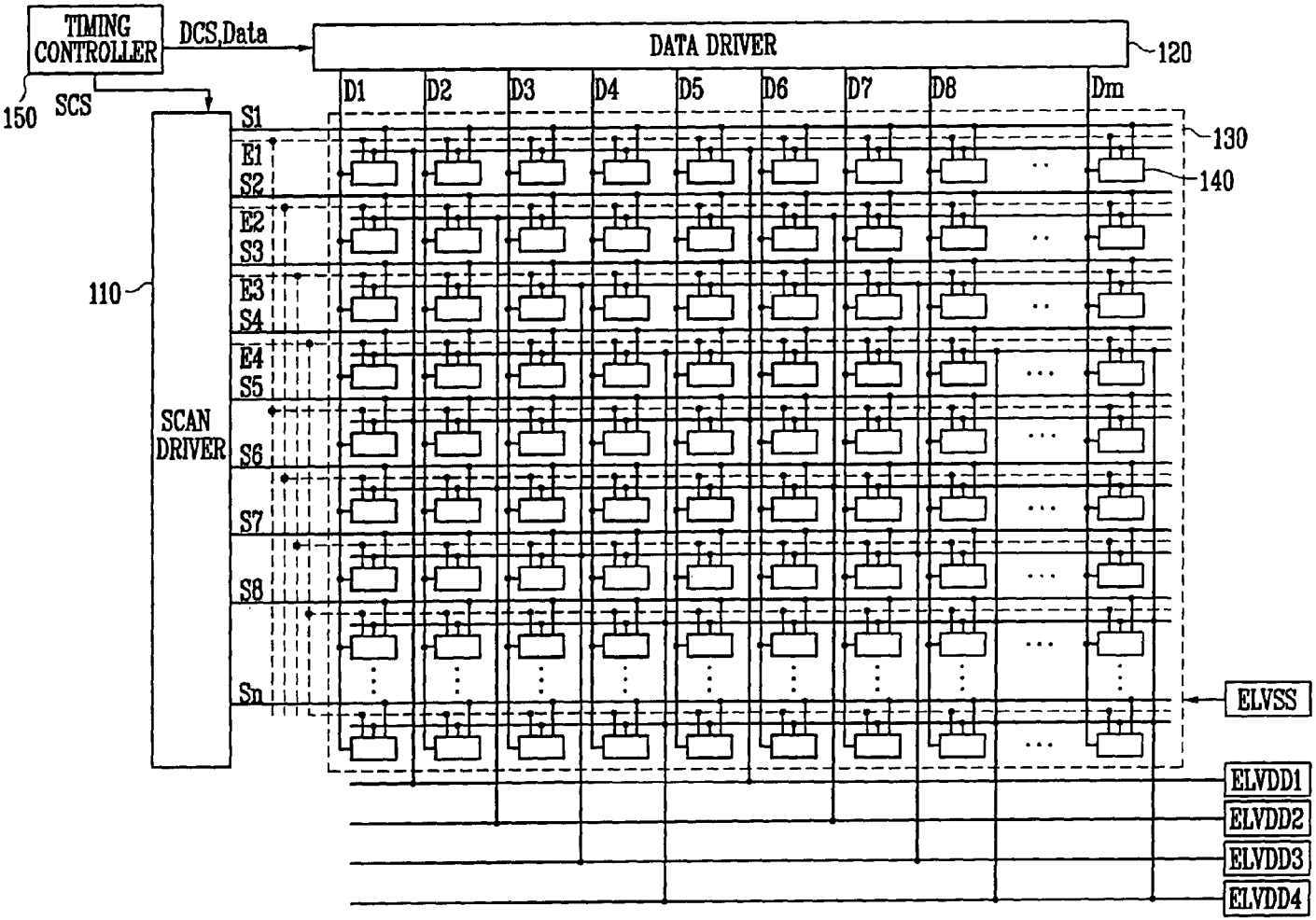
FIG. 9 is a layout diagram of an organic light emitting diode display according to a third embodiment of the present invention.

FIG. 9 is a layout diagram of an organic light emitting diode display according to a third embodiment of the present invention.

Referring to FIG. 9, the organic light emitting diode display according to the third embodiment of the present invention includes four emission control lines E1 through E4 corresponding to the four sub-frames.

Figure 10:
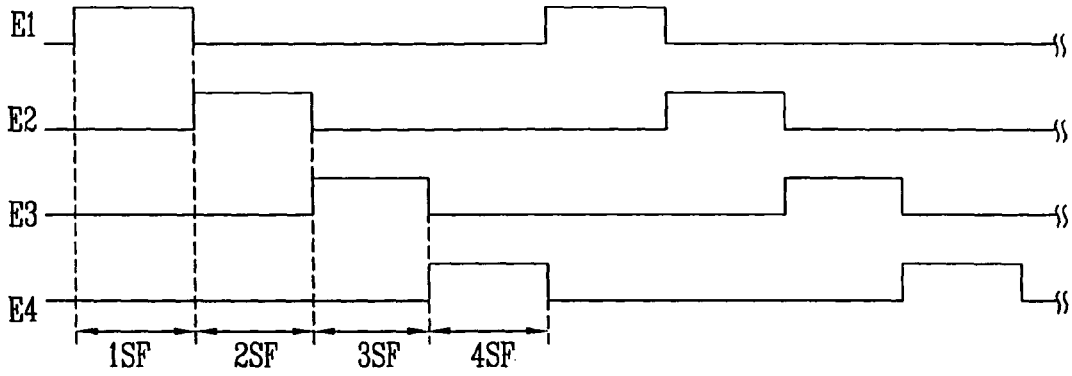
FIG. 10 shows waveforms of emission control signal supplied to emission control lines of FIG. 9.

The first emission control line E1 is connected to the pixels receiving the data signal during the 1st sub-frame 1SF. Here, the first emission control line E1 receives an emission control signal (refer to FIG. 10) during the 1st sub-frame 1SF. Then, the third transistor M3 connected to the first emission control line E1 is turned off. That is, the pixels receiving the data signals during the 1st sub-frame 1SF are set as the non-emission state by the emission control signal supplied to the first emission control line E1.

The second emission control line E2 is connected to the pixels receiving the data signal during the 2nd sub-frame 2SF. Here, the second emission control line E2 receives the emission control signal (refer to FIG. 10) during the 2nd sub-frame 2SF. Then, the second transistor M2 connected to the second emission control line E2 is turned off. That is, the pixels receiving the data signals during the 2nd sub-frame 2SF are set as the non-emission state by the emission control signal supplied to the second emission control line E2.

The third emission control line E3 is connected to the pixels receiving the data signal during the 3rd sub-frame 3SF. Here, the third emission control line E3 receives the emission control signal (refer to FIG. 10) during the 3rd sub-frame 3SF. Then, the third transistor M3 connected to the third emission control line E3 is turned off. That is, the pixels receiving the data signals during the 3rd sub-frame 3SF are set as the non-emission state by the emission control signal supplied to the third emission control line E3.

The fourth emission control line E4 is connected to the pixels receiving the data signal during the 4th sub-frame 4SF. Here, the fourth emission control line E4 receives the emission control signal (refer to FIG. 10) during the 4th sub-frame 4SF. Then, the fourth transistor M4 connected to the fourth emission control line E4 is turned off. That is, the pixels receiving the data signals during the 4th sub-frame 4SF are set as the non-emission state by the emission control signal supplied to the fourth emission control line E4.

Further, according to an embodiment of the present invention, the pixel can be controlled to have the non-emission state, using the second power ELVSS.

Figure 11:
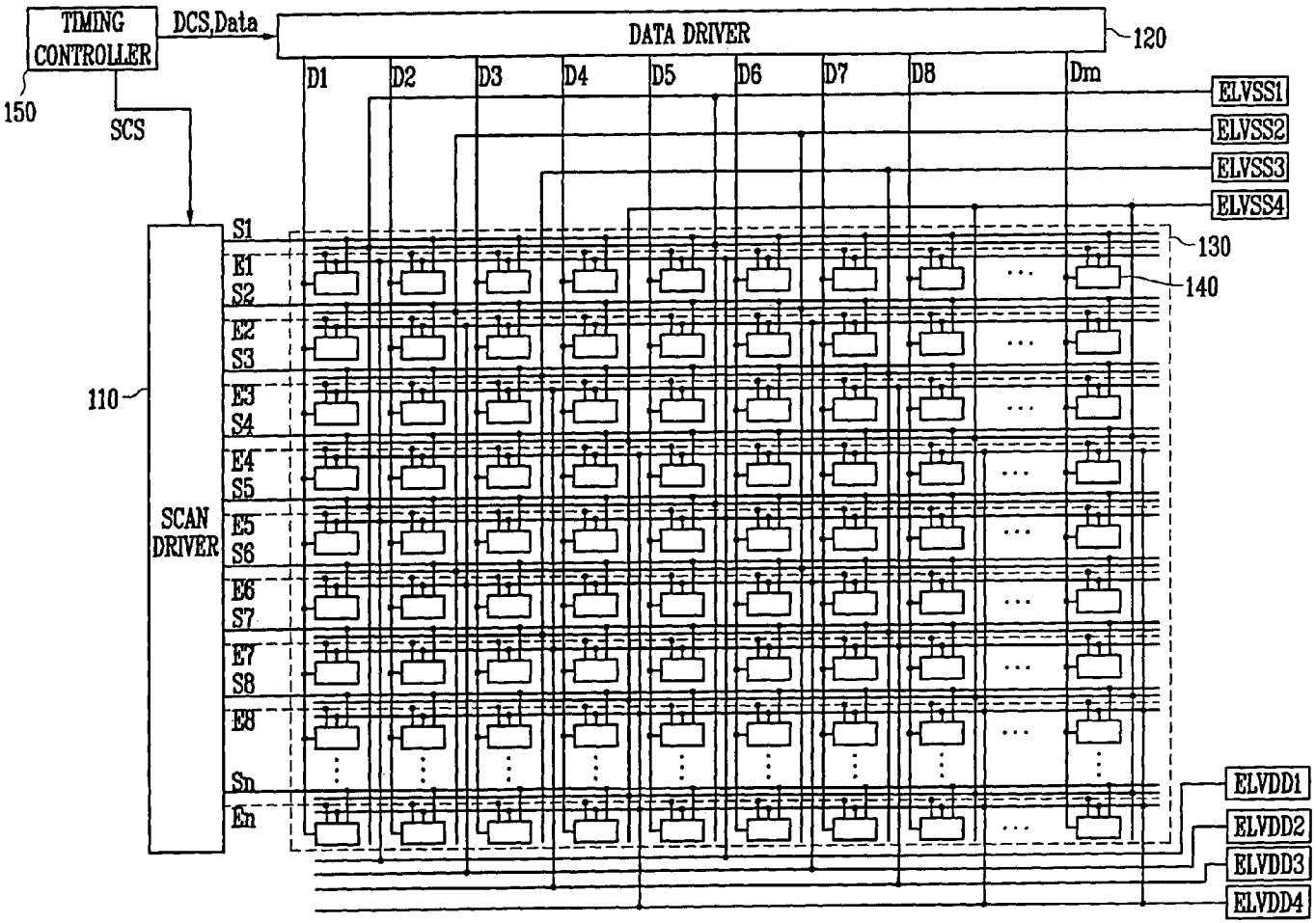
FIG. 11 is a layout diagram of an organic light emitting diode display according to a fourth embodiment of the present invention.

FIG. 11 is a layout diagram of an organic light emitting diode display according to a fourth embodiment of the present invention.

Referring to FIG. 11, in the organic light emitting diode display according to the fourth embodiment of the present invention, the second power line ELVSS can be divided into a fifth divided power ELVSS1, sixth divided power ELVSS2, seventh divided power ELVSS3, and eighth divided power ELVSS4. Here, the fifth through eighth divided power ELVSS1 through ELVSS4 have the same voltage level as the second power ELVSS. That is, the voltage levels of the fifth through eighth divided power lines ELVSS1 through ELVSS4, connected to the cathode electrode of the light emitting device OLED, are set to be lower than those of the first through fourth divided power lines ELVDD1 through ELVDD4, connected to the anode electrode of the light emitting device OLED.

The fifth divided power line ELVSS1 is connected to the pixels receiving the data signal during the 1st sub-frame 1SF. The sixth divided power line ELVSS2 is connected to the pixels receiving the data signal during the 2nd sub-frame 2SF. The seventh divided power line ELVSS3 is connected to the pixels receiving the data signal during the 3rd sub-frame 3SF. The eighth divided power ELVSS4 is connected to the pixels receiving the data signal during the 4th sub-frame.

In the organic light emitting diode display according to the fourth embodiment of the present invention, the fifth through eighth divided power ELVSS1 through ELVSS4 are used for controlling the pixels to have the non-emission state during the respective sub-frames.

During the 1st sub-frame 1SF, the voltage level of the fifth divided power ELVSS1 is increased to make the light emitting device OLED to not emit light. For example, the fifth divided power ELVSS1 can be increased to have the same voltage level as the first divided power ELVDD1 during the 1st sub-frame 1SF. Thus, the fifth divided power ELVSS1 is increased during the 1st sub-frame 1SF, so that the pixels connected to the fifth divided power line ELVSS1 do not emit light.

During the 2nd sub-frame 2SF, the voltage level of the sixth divided power ELVSS2 is increased to make the light emitting device OLED to not emit light. For example, the sixth divided power ELVSS2 can be increased to have the same voltage level as the second divided power ELVDD2 during the 2nd sub-frame 2SF. Thus, the sixth divided power ELVSS2 is increased during the 2nd sub-frame 2SF, so that the pixels connected to the sixth divided power line ELVSS2 do not emit light.

During the 3rd sub-frame 3SF, the voltage level of the seventh divided power ELVSS3 is increased to make the light emitting device OLED to not emit light. For example, the seventh divided power ELVSS3 can be increased to have the same voltage level as the third divided power ELVDD3 during the 3rd sub-frame 3SF. Thus, the seventh divided power ELVSS3 is increased during the 3rd sub-frame 3SF, so that the pixels connected to the seventh divided power line ELVSS3 do not emit light.

During the 4th sub-frame 4SF, the voltage level of the eighth divided power ELVSS4 is increased to make the light emitting device OLED to not emit light. For example, the seventh divided power ELVSS4 can be increased to have the same voltage level as the fourth divided power ELVDD4 during the 4th sub-frame 4SF. Thus, the eighth divided power ELVSS4 is increased during the 4th sub-frame 4SF, so that the pixels connected to the eighth divided power line ELVSS4 do not emit light.

Figure 12:
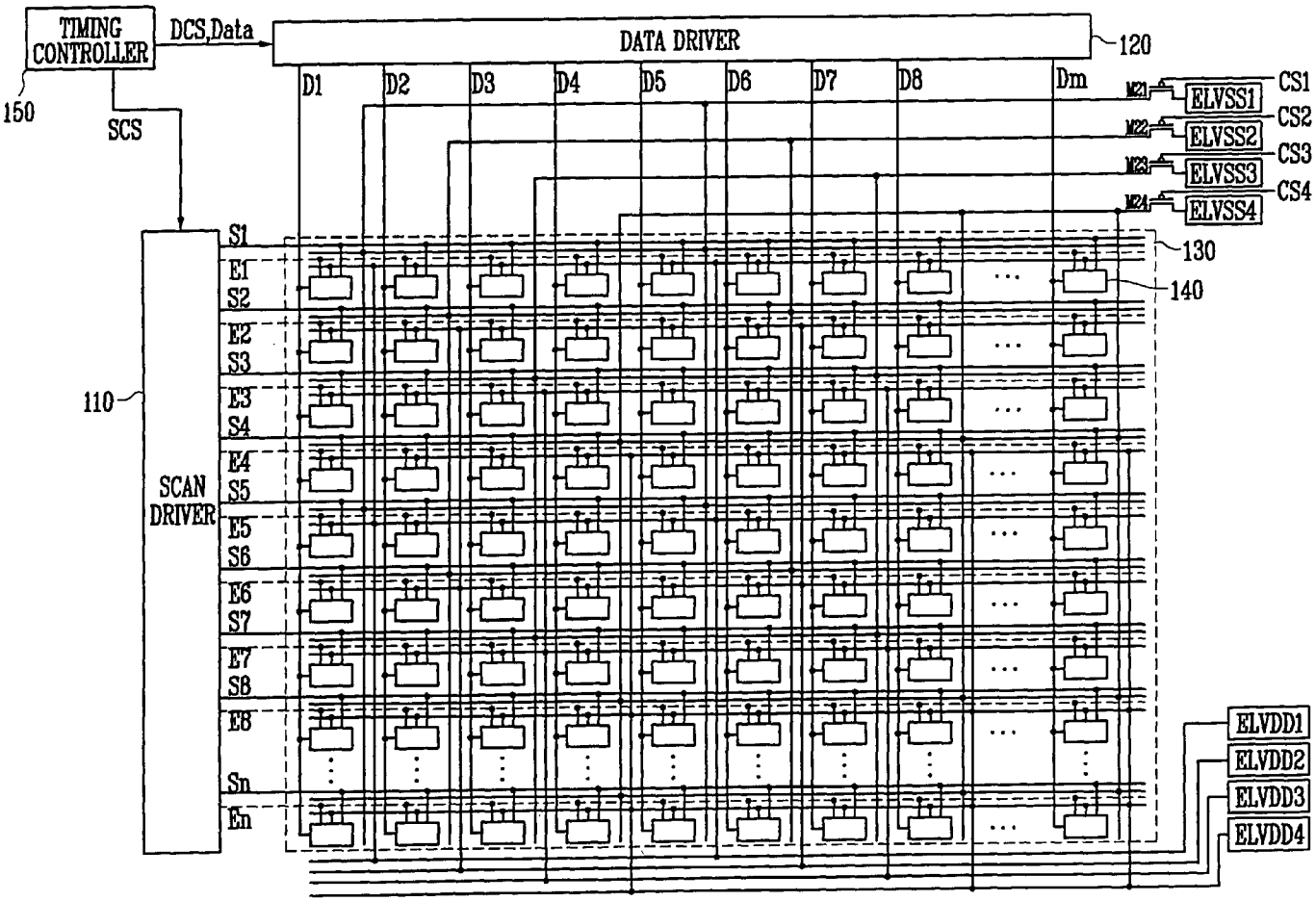
FIG. 12 is a layout diagram of an organic light emitting diode display according to a fifth embodiment of the present invention.

FIG. 12 is a layout diagram of an organic light emitting diode display according to a fifth embodiment of the present invention.

Referring to FIG. 12, the organic light emitting diode display according to the fifth embodiment of the present invention additionally includes first through fourth transistors M21 through M24 respectively connected to the fifth through eighth divided power lines ELVSS1 through ELVSS4 in order to maintain some pixels in the non-emission state during a predetermined sub-frame.

The first transistor M21 is connected to the fifth divided power line ELVSS1. Here, the first transistor M21 is turned off during the $1^{st}$ sub-frame 1SF in response to an external first control signal CS1 (refer to FIG. 12), and turned on during the rest frames 2SF through 4SF. Thus, the pixels connected to the fifth divided power line ELVSS1 do not emit light during the $1^{st}$ sub-frame 1SF.

The second transistor M22 is connected to the sixth divided power line ELVSS2. Here, the second transistor M22 is turned off during the $2^{nd}$ sub-frame 2SF in response to an external second control signal CS2 (refer to FIG. 12), and turned on during the rest frames 1SF, 3SF and 4SF. Thus, the pixels connected to the sixth divided power line ELVSS2 do not emit light during the $2^{nd}$ sub-frame 2SF.

The third transistor M23 is connected to the seventh divided power line ELVSS3. Here, the third transistor M23 is turned off during the $3^{rd}$ sub-frame 3SF in response to an external third control signal CS3 (refer to FIG. 12), and turned on during the rest frames 1SF, 2SF and 4SF. Thus, the pixels connected to the third divided power line ELVSS3 do not emit light during the $3^{rd}$ sub-frame 3SF.

The fourth transistor M24 is connected to the eighth divided power line ELVSS4. Here, the fourth transistor M24 is turned off during the $4^{th}$ sub-frame 4SF in response to an external fourth control signal CS4 (refer to FIG. 12), and turned on during the rest frames 1SF through 3SF. Thus, the pixels connected to the eighth divided power line ELVSS4 do not emit light during the $4^{th}$ sub-frame 4SF.

As described above, according to an embodiment of the present invention, various methods can be used for making some pixels to not emit light during a predetermined sub-frame. Here, the pixels in the non-emission state receive the data signals during a predetermined sub-frame, so that an image is displayed with uniform brightness. Meanwhile, the pixels according to an embodiment of the present invention can have various configurations. For example, the pixel 140 according to an embodiment of the present invention can be configured as shown in FIG. 13 to display an image corresponding to the data signal regardless of the threshold voltage of a transistor.

Figure 13:
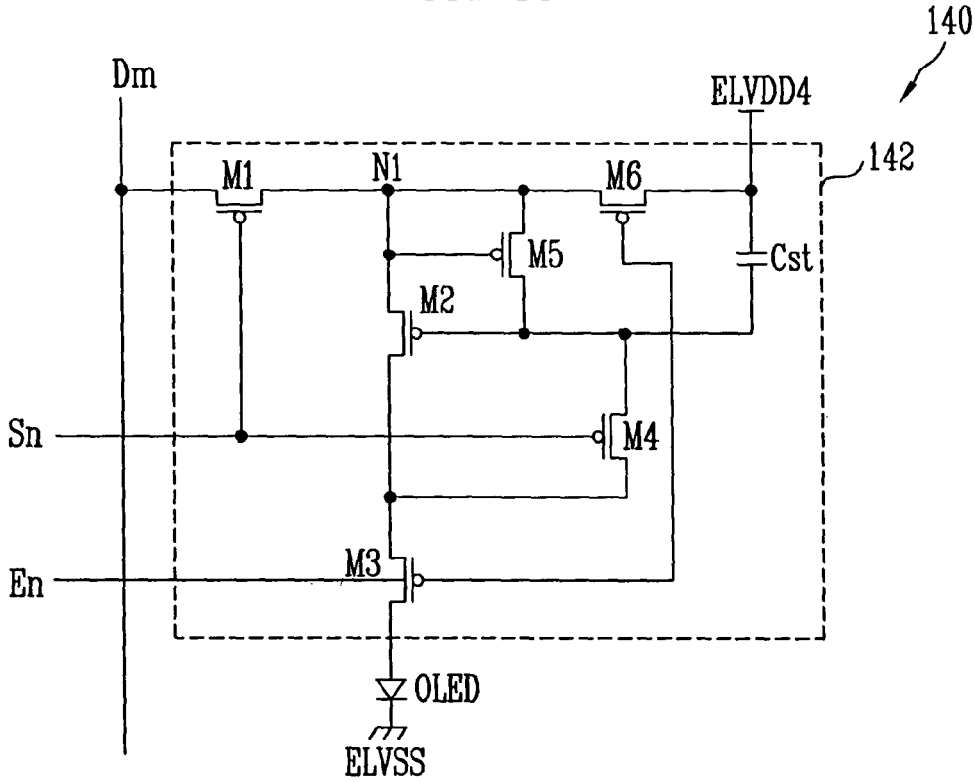
FIG. 13 is a circuit diagram of a pixel according to another embodiment of the present invention.

FIG. 13 is a circuit diagram of a pixel according to another embodiment of the present invention. For the sake of convenience, the pixel connected to the $m^{th}$ data line Dm and the $n^{th}$ scan line Sn will be exemplarily described. Hence, the pixel shown in FIG. 13 is connected with the fourth divided power ELVDD4.

Referring to FIG. 13, each pixel 140 according to an embodiment of the present invention includes a pixel circuit 142 connected with the light emitting device OLED, the data line Dm, the scan line Sn, and the emission control line En, and controlling the light emitting device OLED.

The light emitting device OLED includes the anode electrode connected to the pixel circuit 142 and the cathode electrode connected to the second power line ELVSS. Here, the light emitting device OLED emits light corresponding to current supplied from the pixel circuit 142.

The pixel circuit 142 includes first and sixth transistors M1 and M6 connected between the fourth divided power line ELVDD4 and the data line Dm; a third transistor M3 connected to the light emitting device OLED and the emission control line En; a second transistor M2 connected between the third transistor M3 and a first node N1; a fifth transistor M5 having first and gate electrodes connected to the first node N1 and a second electrode connected to a gate electrode of the second transistor M2; and a fourth transistor M4 connected between the gate and second electrodes of the second transistor M2. Here, the first electrode is used as one of the source and drain electrodes, and the second electrode is used as the other one.

The first transistor M1 has the first electrode connected to the data line Dm, and the second electrode connected to the first node N1. Further, the first transistor M1 has the gate electrode connected to the scan line Sn. Here, the first transistor M1 is turned on in response to the scan signal supplied through the scan line Sn, and supplies the data signal from the data line Dm to the first node N1.

The second transistor M2 has the first electrode connected to the first node N1, and the gate electrode connected to a capacitor Cst. Further, the second transistor M2 has the second electrode connected to the first electrode of the third transistor M3. Here, the second transistor M2 supplies current corresponding to voltage charged in the capacitor Cst to the light emitting device OLED.

The third transistor M3 has the first electrode connected to the second electrode of the second transistor M2, and the gate electrode connected to the emission control line En. Further, the third transistor M3 has the second electrode connected to the light emitting device OLED. Here, the third transistor M3 is turned on while the emission control signal is not supplied through the emission control line En, and supplies the current from the second transistor M2 to the light emitting device OLED.

The fourth transistor M4 has the second electrode connected to the gate electrode of the second transistor M2, and the first electrode connected to the second electrode of the second transistor M2. Further, the fourth transistor M4 has the gate electrode connected to the scan line Sn. Here, the fourth transistor M4 is turned on in response to the scan signal supplied through the scan line Sn, and controls the fourth transistor M4 to be connected like a diode.

The fifth transistor M5 has the gate and first electrodes connected to the first node N1, and the second electrode connected to the gate electrode of the second transistor M2. Here, the fifth transistor M5 is connected like a diode, and supplies an initialization voltage from the data line Dm to the gate electrode of the second transistor M2.

The sixth transistor M6 has the second electrode connected to the first node N1, and the first electrode connected to the fourth divided power line ELVDD4. Further, the sixth transistor M6 has the gate electrode connected to the emission control line En. Here, the sixth transistor M6 is turned on while the emission control signal is not supplied, and electrically connects the first power line ELVDD with the first node N1.

Figure 14:
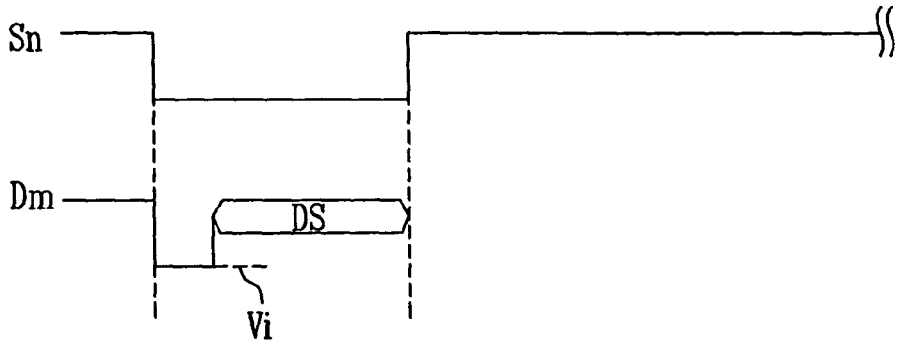
FIG. 14 illustrates a driving method for the pixel of FIG. 13.

Herein below, operations of the pixel 142 will be described with reference to FIG. 14. First, the scan signal is supplied to the scan line Sn, and the initialization voltage Vi is supplied to the data lines D.

When the scan signal is supplied to the $n^{th}$ scan line Sn, the first transistor M1 and the fourth transistor M4 are turned on. As the first transistor M1 is turned on, the initialization voltage Vi is supplied from the data line Dm to the first node N1. Then, the fifth transistor M5 having the diode-like-connection is turned on by the initialization voltage Vi supplied to the first node N1, and thus the initialization voltage Vi is supplied to the gate terminal of the second transistor M2.

When the initialization voltage Vi is supplied to the gate electrode of the second transistor M2, the gate electrode of the second transistor M2 and the capacitor Cst are initialized. In other words, the gate electrode of the second transistor M2 is initialized by the initialization voltage Vi having a voltage level lower than the lowest voltage level of the data signal supplied from the data driver 120. Then, the second transistor M2 is turned on regardless of the voltage level of the data signal supplied to the first node N1.

After supplying the initialization voltage Vi to the gate electrode of the second transistor M2, a data signal DS corresponding to a predetermined gray level is supplied to the data line Dm. Then, the data signal Ds is supplied from the data line Dm to the first node N1 via the first transistor M1. At this time, the gate electrode of the second transistor M2 is initialized by the initialization voltage Vi, so that the second transistor M2 is turned on. As the second transistor M2 is turned on, the data signal Ds applied to the first node N1 is supplied to a first terminal of the capacitor Cst via the second and fourth transistors M2 and M4. At this time, the data signal, of which the voltage is lowered by the voltage corresponding to the threshold voltage Vth of the second transistor M2, is supplied to the first terminal of the capacitor Cst, and thus the capacitor Cst is charged with the voltage corresponding to the data signal and the threshold voltage Vth of the second transistor M2.

In the pixel according to another embodiment of the present invention, the capacitor Cst is charged with the data signal and the voltage corresponding to the threshold voltage Vth, so that an image is displayed with desired brightness. Then, the current corresponding to the voltage charged in the capacitor Cst is supplied to the light emitting device OLED during the rest frames except for the sub-frame supplying the data signal, thereby displaying an image.

As described above, the present invention provides an organic light emitting diode display and a driving method thereof, in which one frame is divided into a plurality of sub-frames, and pixels receiving data signals during a sub-frame are maintained in a non-emission state, so that pixels are respectively charged with desired voltages. Thus, an image is displayed with uniform brightness corresponding to the data signal.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. An organic light emitting diode display capable of dividing one frame into a plurality of sub-frames, the organic light emitting diode display comprising:

a plurality of scan lines;

a plurality of data lines;

a plurality of pixels connected to said scan lines and said data lines;

a scan driver to supply scan signals to at least two of said scan lines during each of the sub-frames, the at least two of the scan lines receiving the scan signals at different time periods in the each of the sub-frames;

a data driver to supply data signals corresponding to said scan signals; and a plurality of first power sources connected to said pixels, one of the first power sources being connected to anode electrodes of light emitting devices of pixels connected to the at least two of said scan lines, a number of the first power sources being the same as a number of the sub-frames.

2. The organic light emitting diode display according to claim 1, wherein said scan driver supplies the scan signals to 1/i scan lines among the scan lines provided in the pixel portion per sub-frame, where i is the number of sub-frames corresponding to one frame.

3. The organic light emitting diode display according to claim 2, wherein said data driver supplies the data signal to the pixels connected to the pixels receiving the scan signals during each sub-frame.

4. The organic light emitting diode display according to claim 3, wherein the pixel portion comprises i first power sources, and the pixels receiving the data signal during the same sub-frame are connected to the same first power source among i first power sources.

5. The organic light emitting diode display according to claim 4, wherein said first power source among i first power sources, connected with the pixels receiving the data signal, has a voltage level enough to make the pixels do not emit light during the sub-frame for receiving the data signal.

6. The organic light emitting diode display according to claim 4, further comprising i transistors connected to i first power sources, respectively.

7. The organic light emitting diode display according to claim 6, wherein the transistors among i transistors, connected to the pixels receiving the data signal, are turned on during the sub-frame for receiving the data signal, and the rest of the transistors are turned off during the same sub-frame.

8. The organic light emitting diode display according to claim 4, wherein each one of the plurality of pixels comprises:

a first transistor connected to said scan line and said data line, and controlled by the scan signal;

a second transistor to control current to be supplied to said light emitting device in correspondence to the data signal;

a capacitor connected to said second transistor and charged with voltage corresponding to the data signal; and a third transistor connected to an emission control line, tuned off for a period while an emission control signal is supplied from said scan driver, and tuned on for rest of the period.

9. The organic light emitting diode display according to claim 8, wherein the emission control line is formed in parallel with said scan line, and provided as the same number as i sub-frames.

10. The organic light emitting diode display according to claim 9, wherein the pixels receiving the data signal during the same sub-frame are connected to the same emission control line.

11. The organic light emitting diode display according to claim 10, wherein said scan driver supplies an emission control signal to one emission control line among i emission control lines per sub-frame the pixels to control the pixels receiving the data signals to not emit light.

12. The organic light emitting diode display according to claim 3, further comprising i second power sources connected to cathode electrodes of said light emitting devices provided in said pixels.

13. The organic light emitting diode display according to claim 12, wherein said pixels receiving the data signal during the same sub-frame are connected to the same second power source among i second power sources.

14. The organic light emitting diode display according to claim 13, wherein said second power source among i second power sources, connected with the pixels receiving the data signal, has a voltage level enough to make the pixels, do not emit light during the sub-frame for receiving the data signal.

15. The organic light emitting diode display according to claim 13, further comprising i transistors connected to i second power sources, respectively.

16. The organic light emitting diode display according to claim 15, wherein one transistor among i transistors, connected to said pixels receiving the data signal, is turned on during the sub-frame for receiving the data signal, and the rest of the transistors are turned off during the same sub-frame.

17. A method of driving an organic light emitting diode display including a plurality of scan lines provided in a pixel portion, comprising:

dividing one frame into at least two sub-frames; and supplying scan signals to at least two of the scan lines during each of the sub-frames, the at least two of the scan lines receiving the scan signals at different time periods in the each of the sub-frames, pixels connected to the at least two of the scan lines not emitting light during the each of the sub-frames.

18. The method according to claim 17, wherein the scan signals are supplied to 1/i scan lines among said scan lines provided in the pixel portion per sub-frame, where, i is the number of sub-frames corresponding to one frame.

19. The method according to claim 18, wherein data signals are supplied to the pixels receiving the scan signals during each sub-frame.

20. The method according to claim 19, further comprising controlling the pixels receiving the data signals do not emit light during the sub-frame for receiving the data signal.

21. The method according to claim 20, wherein the controlling of the pixels to not emit light comprises decreasing a voltage level of a power source connected to an anode electrode of a light emitting device provided in each pixel receiving the data signal.

22. The method according to claim 20, wherein the controlling of the pixels to not emit light comprises interrupting power supplied from a power source connected to an anode electrode of a light emitting device provided in each pixel receiving the data signal.

23. The method according to claim 20, wherein the controlling of the pixels to not emit light comprises turning off a transistor that is provided in each pixel receiving the data signal and controls a point of time for supplying a current flowing in the light emitting device.

24. The method according to claim 20, wherein the controlling of the pixels to not emit light comprises increasing a voltage level of a power source connected to a cathode electrode of a light emitting device provided in each pixel receiving the data signal.

25. The method according to claim 20, wherein the controlling of the pixels to not emit light comprises interrupting power supplied from a power source connected to a cathode electrode of a light emitting device provided in each pixel receiving the data signal.

26. A method of driving an organic light emitting diode display including a plurality of scan lines provided in a pixel portion, comprising:

dividing one frame into a plurality of sub-frames; and supplying scan signals to at least two of the scan lines during each of the sub-frames, the at least two of the scan lines receiving the scan signals at different time periods in the each of the sub-frames, pixels connected to the at least two of the scan lines being in a non-emission state during the each of the sub-frame, rest of the pixels being in an emission state during the each of the sub-frame.

27. The method according to claim 26, wherein data signals are supplied to the pixels set as the non-emission state during each sub-frame.

28. The method according to claim 27, wherein 1/i pixels among the pixels provided in the pixel portion do not emit light per sub-frame, where, i is the number of sub-frames corresponding to one frame.

29. The method according to claim 28, wherein the pixels set as the non-emission state are different per sub-frame of one frame.

30. The method according to claim 26, wherein the number of pixels set as the emission state is larger than the number of pixels set as the non-emission state.

31. A method of driving an organic light emitting diode display including a plurality of scan lines provided in a pixel portion, comprising:

dividing one frame into a plurality of sub-frames;

setting a number of first power sources connected to anode electrodes of light emitting devices provided in pixels to be equal to a number of the sub-frames;

supplying scan signals to at least two of the scan lines during each of the sub-frames the at least two of the scan lines receiving the scan signals at different time periods in the each of the sub-frames; and supplying data signals to pixels connected to the at least two of the scan lines during the each of the sub-frame, the pixels not emitting light during the each of the sub-frames.

32. The method according to claim 31, wherein the data signals are supplied to 1/i pixels among the pixels provided in the pixel portion per sub-frame, where i is the number of sub-frames corresponding to one frame.

33. The method according to claim 32, wherein the pixels provided in the pixel portion do not emit light during one or more sub-frames among i sub-frames, and emit light during the rest of the sub-frames.

34. The method according to claim 33, wherein the pixel portion comprises i first power sources, and the pixels that do not emit light during the same sub-frame are connected to the same first power source among i first power sources.

35. The method according to claim 34, wherein the pixels that do not emit light during different sub-frames of one frame are connected to different first power sources among i first power sources, respectively.

* * * * *